US010744364B2

(12) United States Patent
Smith, III

(10) Patent No.: US 10,744,364 B2
(45) Date of Patent: Aug. 18, 2020

(54) EXERCISE MACHINE FOR FLUENT AGONIST-ANTAGONIST MUSCLE TRAINING

(71) Applicant: James E. Smith, III, Joppa, MD (US)

(72) Inventor: James E. Smith, III, Joppa, MD (US)

( * ) Notice: Subject to any disclaimer, the term of this patent is extended or adjusted under 35 U.S.C. 154(b) by 73 days.

(21) Appl. No.: 15/838,767

(22) Filed: Dec. 12, 2017

(65) Prior Publication Data

US 2018/0161614 A1 Jun. 14, 2018

Related U.S. Application Data

(60) Provisional application No. 62/433,808, filed on Dec. 14, 2016.

(51) Int. Cl.

| | |
|---|---|
| ***A63B 21/04*** | (2006.01) |
| ***A63B 21/055*** | (2006.01) |
| ***A63B 21/005*** | (2006.01) |
| ***A63B 21/00*** | (2006.01) |

(52) U.S. Cl.

CPC ..... *A63B 21/0442* (2013.01); *A63B 21/0051* (2013.01); *A63B 21/04* (2013.01); *A63B 21/055* (2013.01); *A63B 21/0557* (2013.01); *A63B 21/4035* (2015.10)

(58) Field of Classification Search

CPC ..... A63B 21/153–155; A63B 21/225; A63B 21/4033; A63B 21/4043

See application file for complete search history.

(56) References Cited

U.S. PATENT DOCUMENTS

| | | | | |
|---|---|---|---|---|
| 5,080,349 | A * | 1/1992 | Vittone | A63B 23/14 482/106 |
| 7,887,463 | B2 | 2/2011 | Neuberg et al. | |
| 2003/0027694 | A1 * | 2/2003 | Harrison | A63B 21/0615 482/94 |
| 2006/0199708 | A1 * | 9/2006 | Alessandri | A63B 21/154 482/99 |
| 2013/0310230 | A1 * | 11/2013 | Norris | A63B 21/018 482/115 |

* cited by examiner

*Primary Examiner* — Jennifer Robertson

(74) *Attorney, Agent, or Firm* — Peter J. Van Bergen

(57) ABSTRACT

An exercise machine is provided for agonist-antagonist muscle training. A first variable resistance mechanism has a first line extending therefrom, a second variable resistance mechanism has a second line extending therefrom, and a user-engaged link is coupled to the first line and second line with the first line, second line, and link being aligned along a common axis. When the user applies a first tensile force to the first line via the link, the first line extends from the first variable resistance mechanism against its resistance force while the second line retracts towards the second variable resistance mechanism under its restoring force. Then, when the user applies a second tensile force to the second line via the link, the second line extends from the second variable resistance mechanism against its resistance force while the first line retracts towards the first variable resistance mechanism under its restoring force.

4 Claims, 6 Drawing Sheets

EXERCISE MACHINE FOR FLUENT AGONIST-ANTAGONIST MUSCLE TRAINING

Pursuant to 35 U.S.C. § 119, the benefit of priority from provisional application 62/433,808, with a filing date of Dec. 14, 2016, is claimed for this non-provisional application.

FIELD OF THE INVENTION

The invention relates generally to exercise machines, and more particularly to an exercise machine that allows a user to work agonist-antagonist muscle groups (e.g., biceps/triceps) in a fluent fashion.

BACKGROUND OF THE INVENTION

Exercise machines are typically designed to work a particular muscle group based on machine set-up. Working another muscle group entails reconfiguration of the machine or switching to a completely different machine. Since it is desirable to work agonist-antagonist muscle groups in succession (e.g., biceps/triceps, quadriceps/hamstrings, chest/back, etc.), a good portion of an exercise routine is spent moving between machines and/or reconfiguring machines. For example, multi-exercise machines employing multiple weight stacks and cabling mechanisms allow a user to set the position of attachment points for user-engaged handles depending on the desired exercise and muscle group that is to be worked. However, re-configuring these types of machines takes time and some level of expertise in order to properly position/configure the machine for an effective and safe exercise routine. When one is using dedicated muscle-group exercise machines, time and expertise are required to move to a different machine and then properly configure the machine for an effective and safe exercise routine.

SUMMARY OF THE INVENTION

Accordingly, it is an object of the present invention to provide an exercise machine for working agonist-antagonist muscle groups in a fluent fashion.

Other objects and advantages of the present invention will become more obvious hereinafter in the specification and drawings.

In accordance with the present invention, an exercise machine is provided for agonist-antagonist muscle training. A first variable resistance mechanism having a first line extending therefrom is adapted to have a first tensile force applied thereto wherein the first line extends from the first variable resistance mechanism when the first tensile force exceeds a first resistance force of the first variable resistance mechanism. The first line retracts towards the first variable resistance mechanism by a first restoring force of the first variable resistance mechanism when the first tensile force is terminated. The first resistance force is greater than the first restoring force. A second variable resistance mechanism having a second line extending therefrom is adapted to have a second tensile force applied thereto wherein the second line extends from the second variable resistance mechanism when the second tensile force exceeds a second resistance force of the second variable resistance mechanism. The second line retracts towards the second variable resistance mechanism by a second restoring force of the second variable resistance mechanism when the second tensile force is terminated. The second resistance force is greater than the second restoring force. A link is coupled to the first line and the second line wherein the first line, the second line, and the link are aligned along a common axis. The link is adapted to be engaged by a user. In operation, when the user applies the first tensile force in excess of the first resistance force to the first line via the link, the first line extends from the first variable resistance mechanism against the first resistance force while the second line retracts towards the second variable resistance mechanism under the second restoring force. Then, when the user applies the second tensile force in excess of the second resistance force to the second line via the link, the second line extends from the second variable resistance mechanism against the second resistance force while the first line retracts towards the first variable resistance mechanism under the first restoring force.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
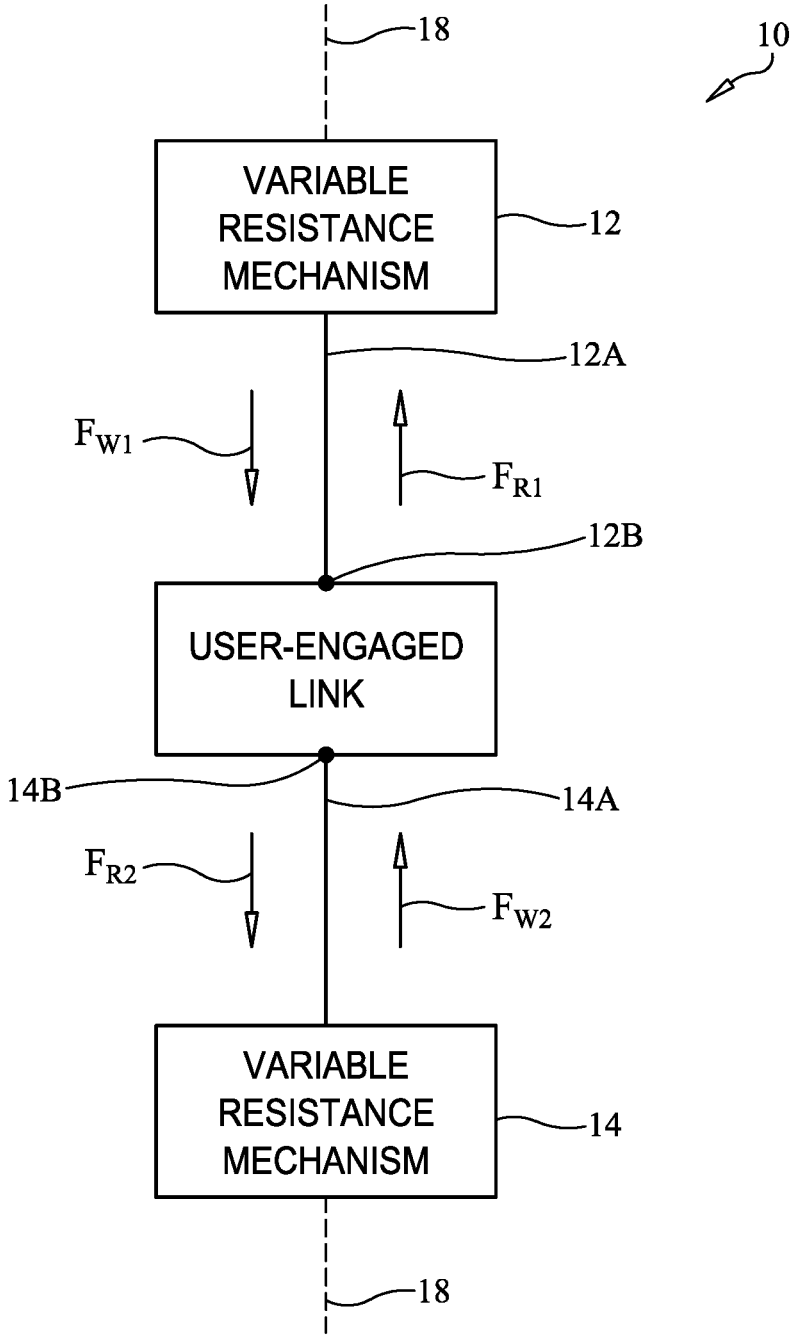
FIG. 1 is a schematic view of an exercise machine for working agonist-antagonist muscle groups in a fluent fashion in accordance with the present invention.

Referring now to the drawings and more particularly to FIG. 1, an exercise machine for the fluent training of opposing or agonist-antagonist muscle groups in accordance with the present invention is shown and is referenced generally by numeral 10. Exercise machine 10 can be adapted to work with a variety of agonist-antagonist muscle groups to include, for example, biceps/triceps, quadriceps/hamstrings, and chest/back muscle groups. By way of an illustrative example, a biceps/triceps exercise machine in accordance with the present invention will be described later herein.

In general, exercise machine 10 includes two independently-adjustable variable resistance mechanisms 12 and 14, and a user-engaged link 16. Variable resistance mechanism 12 includes a line 12A (e.g., chain, cable, belt, etc., or combinations thereof) that is extendable from mechanism 12 through application of a work force $F_{W1}$ to line 12A directed as shown to oppose a user-adjustable resistance of mechanism 12. Variable resistance mechanism 12 also applies a separate and relatively weak restoring force $F_{R1}$ to line 12A to thereby retract line 12A towards mechanism 12 when the work force $F_{W1}$ is not present. Restoring force $F_{R1}$ is applied in direction that is in opposition to work force $F_{W1}$. Similarly, variable resistance mechanism 14 includes a line 14A (e.g., chain, cable, belt, etc., or combinations thereof) that is extendable from mechanism 14 through application of a work force $F_{W2}$ to line 14A directed as shown to oppose a user-adjustable resistance of mechanism 14. Variable resistance mechanism 14 also applies a separate and relatively weak restoring force $F_{R2}$ to line 14A to thereby retract line 14A towards mechanism 14 when the work force $F_{W2}$ is not present. Restoring force $F_{R2}$ is applied in a direction that is in opposition to work force $F_{W2}$.

Each of the respective restoring forces associated with variable resistance mechanisms 12 and 14 is sufficient to retract the respective lines 12A and 14A towards their mechanisms without any significant impact on the muscle contraction force (i.e., the above-described work forces) being applied. That is and in general, the work force will always be greater than the restoring force. For example, each variable resistance mechanism can employ a user-adjustable mechanism for resistance (e.g., magnetic resistance mechanism) and a separate non-adjustable mechanism (e.g., a low-force spring mechanism) for application of the restoring force. In order to produce an agonist-antagonist muscle group exercise that resembles a free-weight exercise combination, variable resistance mechanisms 12 and 14 are spaced-apart from one another and can be positioned such that lines 12A/14A and user-engaged link 16 align along a common axis 18 of exercise machine 10.

User-engaged link 16 is coupled to outboard ends 12B and 14B of lines 12A and 14A, respectively. Such coupling can permanently couple link 16 to outboard ends 12B/14B, but can also be one that provides for attachment/detachment of link 16 to/from outboard ends 12B/14B as will be described for several embodiments later herein. In general, link 16 defines the point of attachment to/with a user's body so that the work forces can be applied to the appropriate one of line 12A or line 14A. Depending on the agonist-antagonist muscle group being worked, link 16 can be a device that is gripped by a user's hands or could be a bracelet attachable to, for example, a user's leg/ankle.

In operation, a user adjusts the resistance on each mechanism 12 and 14. Such adjustment only impacts the work force needed for the particular muscle group that will be contracted during application of the work force. The user then engages link 16 and applies a work force (e.g., $F_{W1}$) to variable resistance mechanism 12 to thereby exercise (e.g., contract) an agonist muscle group while the much weaker and fixed restoring force $F_{R2}$ is simultaneously applied to line 14A by variable resistance mechanism 14 such that the corresponding antagonist muscle group is not worked while keeping line 14A from going slack. At the end of the exercise stroke applying work force $F_{W1}$, the user applies work force $F_{W2}$ to variable resistance mechanism 14 to thereby exercise the previous antagonist muscle group while a restoring force $F_{R1}$ is simultaneously applied to line 12A by variable resistance mechanism 12 such that the previous agonist muscle group is not worked while keeping line 12A from going slack. The above-described process is repeated for a desired number of repetitions with each repetition providing for a fluent transition between the work strokes of agonist-antagonist muscle groups.

Figure 2:
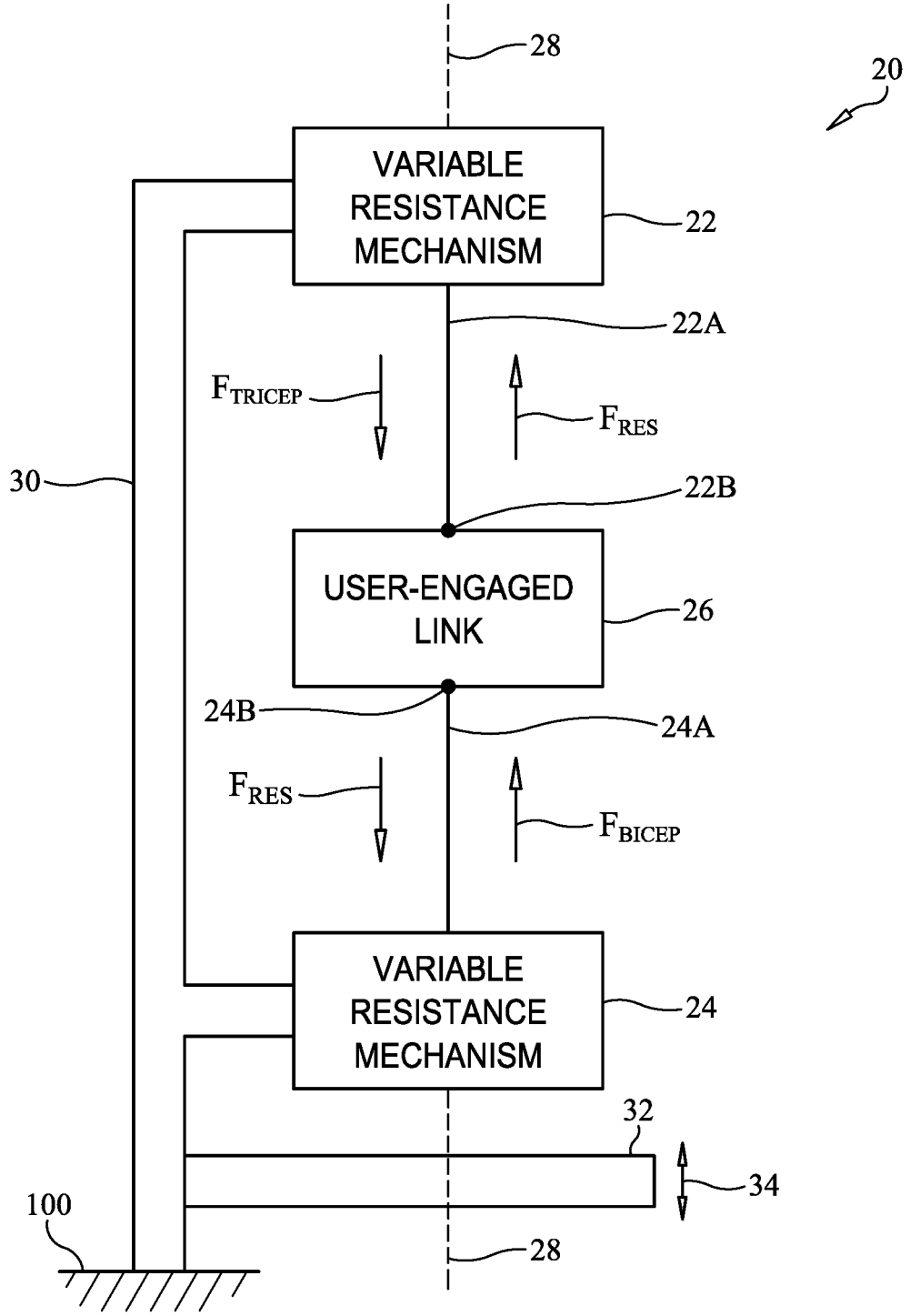
FIG. 2 is a schematic view of an exercise machine for exercising biceps and triceps muscle groups in a fluent fashion in accordance with an embodiment of the present invention.

Referring now to FIG. 2, an exercise machine for exercising the biceps and triceps muscle groups in a fluent fashion is shown and is referenced generally by numeral 20. Exercise machine 20 includes a frame 30 that can rest on or be permanently attached to a support surface 100 (e.g., a floor as shown or a wall) without departing from the scope of the present invention. A support platform 32 can be coupled to frame 30 for the support of a user in a standing or sitting position. Platform 32 can be adjustable in height relative to frame 30 as indicated by two-headed arrow 34.

Coupled to frame 30 are independently-adjustable variable resistance mechanisms 22 and 24. In the illustrated embodiment, mechanisms 22 and 24 are rigidly coupled to frame 30 at spaced-apart vertical locations with mechanism 22 coupled to an upper portion of frame 30 and mechanism 24 coupled to a lower portion of frame 30. Similar to exercise machine 10, variable resistance mechanism 22 includes a line 22A and variable resistance mechanism 24 includes a line 24A. A user-engaged link 26 is coupled to the outboard ends 22B and 24B of lines 22A and 24A, respectively. Lines 22A/24A, link 26, and platform 32 are arranged vertically, i.e., either in vertical alignment with one another along a vertical axis 28 of exercise machine 20 or parallel to vertical axis 28.

In use, a user sets/adjusts the independently-adjustable resistances of mechanisms 22 and 24, steps onto platform 32, and engages link 26. The fluent biceps/triceps exercise can begin with a biceps curl or triceps extension. Assuming the fluent exercise is to begin with a biceps curl, a user positions link 26 and lines 12A/14A to begin a biceps curl exercise that applies force $F_{BICEP}$ to mechanism 24 as mechanism 22 simultaneously applies its relatively weak restoring force $F_{RES}$ on line 22A. At the completion of the biceps curl, the user immediately commences a triceps extension exercise that applies force $F_{TRICEP}$ to mechanism 22 as mechanism 24 simultaneously applies its relatively weak restoring force $F_{RES}$ on line 24A. The above routine is repeated for a desired number of repetitions.

Figure 3:
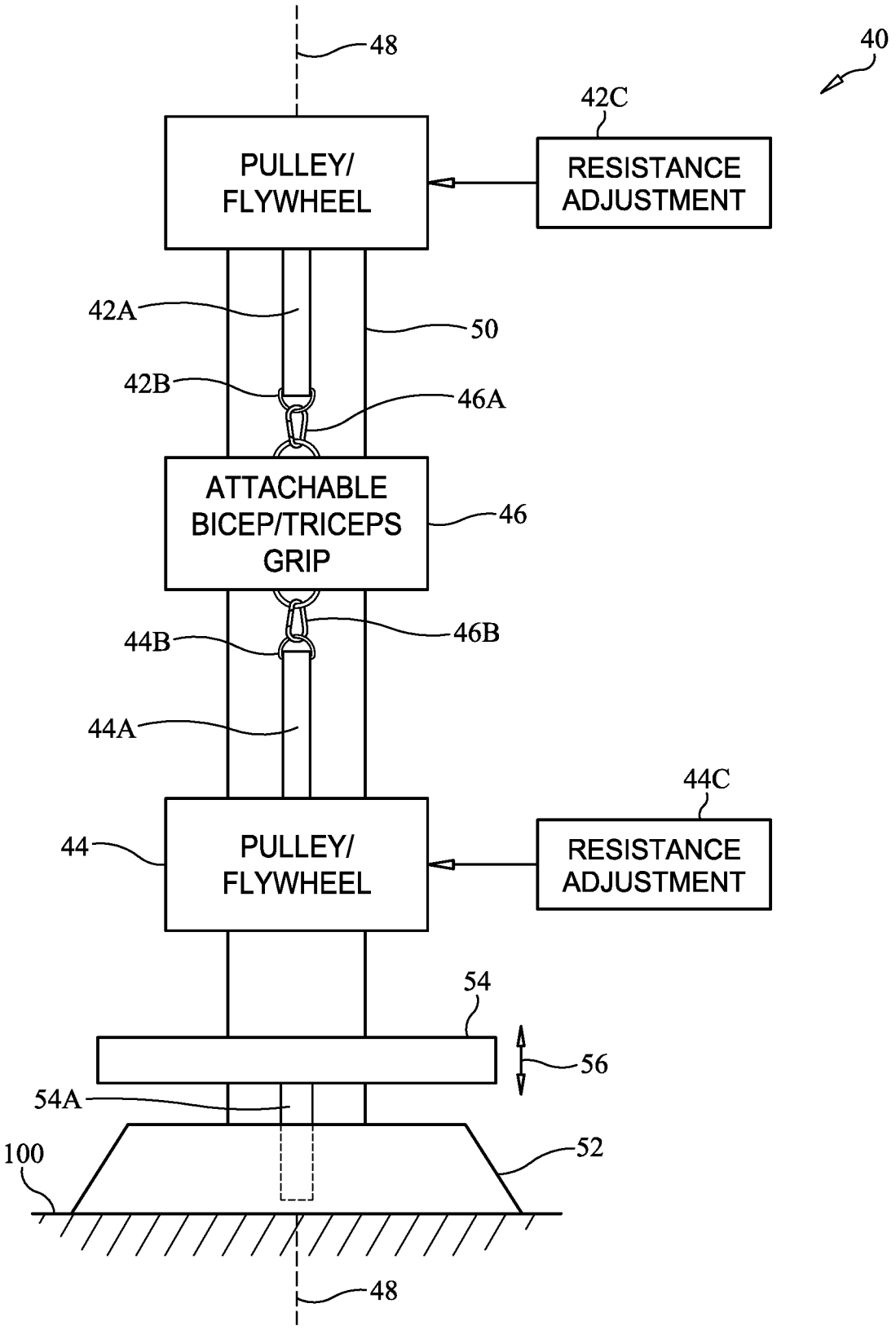
FIG. 3 is a schematic view of a biceps/triceps exercise machine in accordance with another embodiment of the present invention.

Referring now to FIG. 3, another embodiment of a biceps/triceps exercise machine in accordance with the present invention is shown and is referenced generally by numeral 40. Exercise machine 40 includes a rigid frame 50 whose base 52 rests on a support surface 100. A user support platform 54 includes a mounting post 54A extending from base 52. Post 54A can define a number of height adjustment positions (not shown) such that the height of platform 54 can be adjusted up or down along or parallel to a common vertical axis 48 as indicated by two-headed arrow 56. It is to be understood that a free-standing and adjustable-height platform could also be used without departing form the scope of the present invention.

Coupled to frame 50 are pulley/flywheel mechanisms 42 and 44, each of which has a line 42A and 44A, respectively, extending therefrom. Lines 42A and 44A have outboard ends terminating in rings 42B and 44B, respectively. Lines 42A and 44 are in vertical alignment with one another along common vertical axis 48 of exercise machine 40. Each pulley/flywheel has its own resistance adjustment 42C/44C associated therewith. Each pulley/flywheel also incorporates a spring (not shown) for applying a fixed and relatively weak restoring force to respective lines 42A and 44A when no work force is being applied to the lines as previously described herein. By way of example, designs of suitable adjustable-resistance pulley/flywheel mechanisms can be found in the art of stationary rowing machines. An attachable biceps/triceps grip 46 has D-links 46A/46B (or other suitable attaching devices) coupled thereto for temporary attachment to rings 42B/44B as shown. As is well known in the art, D-links are used for quick attachment or detachment of exercise accessories. A variety of designs/options for grip 46 will now be explained with reference to FIGS. 4-7.

Figure 4:
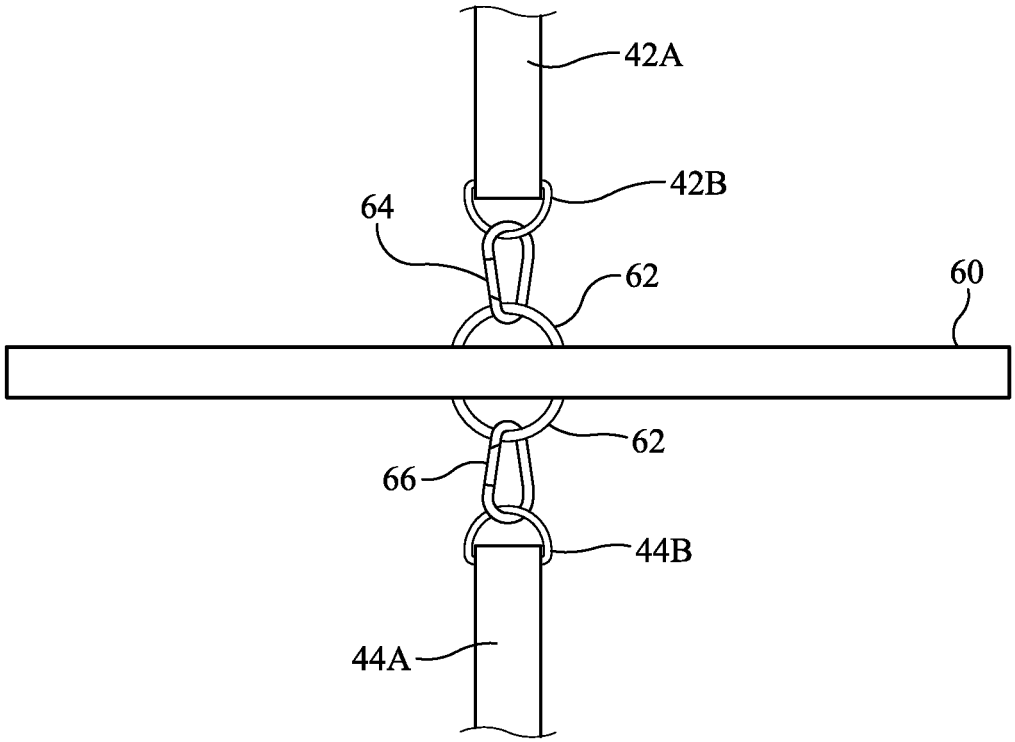
FIG. 4 is an isolated view of a rigid bar grip for coupling to a biceps/triceps exercise machine in accordance with an embodiment of the present invention.

Referring first to FIG. 4, a biceps/triceps grip can be realized by a rigid cylindrical bar 60 having fixed attachment points (e.g., D-rings) 62 positioned at diametrically opposing locations at a central portion of bar 60. D-links 64/66 can be provided to couple bar 60 via points 62 to lines 42A and 44A as described above such that the outboard ends of bar 60 are on opposite sides of the exercise machine's common vertical axis aligned with lines 42A and 44A.

Figure 5:
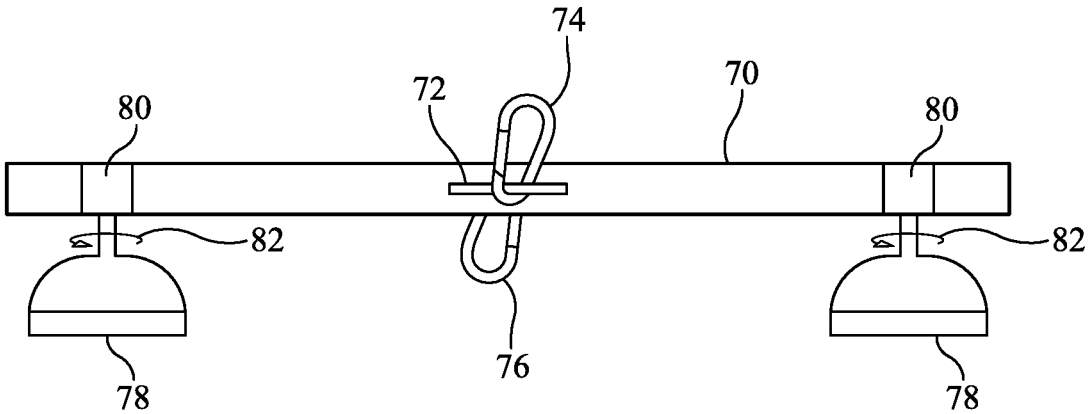
FIG. 5 is an isolated view of a rigid bar having pivoting grip handles for coupling to a biceps/triceps machine in accordance with another embodiment of the present invention.

In FIG. 5, a rigid bar 70 has centrally-positioned and fixed attachment points (only one of which is visible) 72 in diametric opposition to one another. A D-link 74 or 76 can be coupled to each attachment point 72. Positioned near each longitudinal end of bar 70 is a hand grip or handle 78 that is coupled to bar 70 by a pivot joint 80 that allows handle 78 to rotate as indicated by rotational arrow 82. In this way, a user can grip handles 78 (located on opposite sides of the exercise machine's common vertical axis) and rotate his/her hands to a desired orientation for a biceps exercise (e.g., palm up or palm sideways for hammer curl) or triceps exercise and then change their orientation as and when needed.

Figure 6:
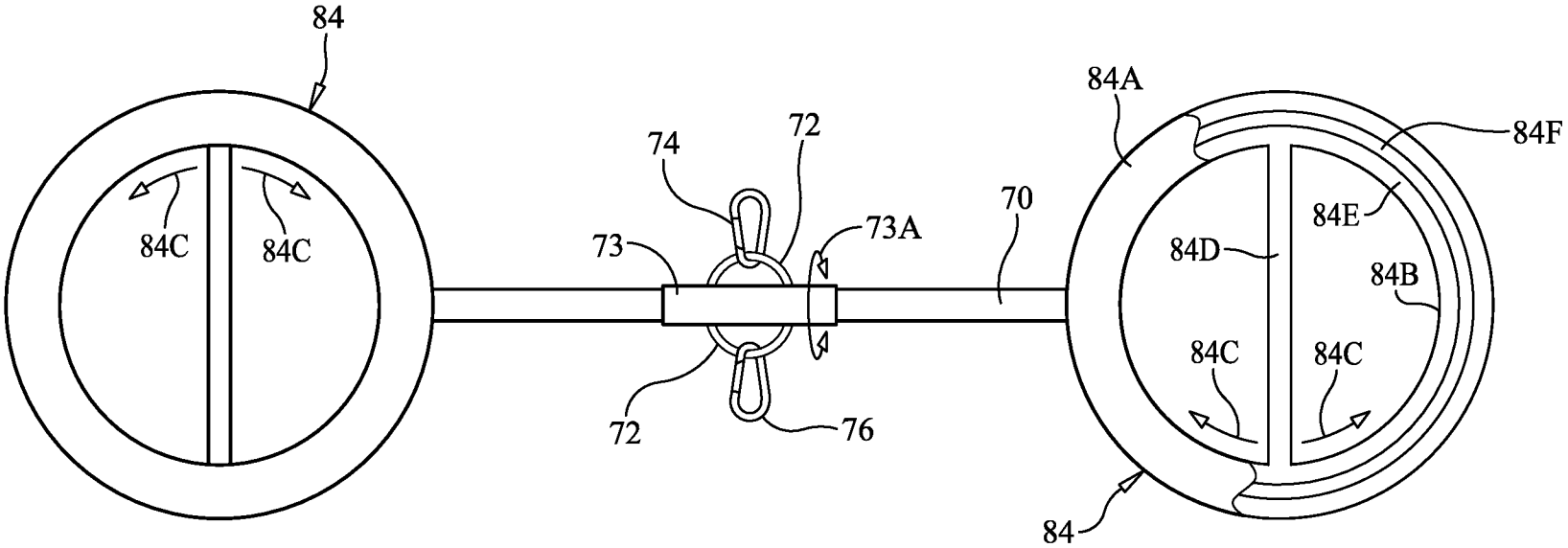
FIG. 6 is an isolated and partial cut-away view of a rigid bar having rotating grip handles for coupling to a biceps/triceps machine in accordance with another embodiment of the present invention.

In FIG. 6, a rigid bar 70 has centrally-positioned and rotatable attachment points 72 in diametric opposition to one another. More specifically, attachment points 72 are rigidly coupled to a collar 73 configured for free rotation about bar 70 as indicated by arrow 73A. A D-link 74 or 76 can be coupled to each attachment point 72. Positioned near each longitudinal end of bar 70 is a hand grip or handle assembly 84 that is coupled to bar 70. Each handle assembly 84 includes an outer ring 84A fixed to an end of bar 70, and an inner ring 84B mounted within outer ring 84A such that inner ring 84B can freely rotate relative to outer ring 84A in a clockwise or counterclockwise rotation as indicated by arrows 84C. A grip or handle 84D spans the diameter of inner ring 84B and is fixed to inner ring 84B. Inner ring 84B can have a continuous or discontinuous annular flange 84E that is captured within an annular groove 84F defined in outer ring 84A in a way that supports free rotation 84C. In this way, a user can grip handles 84D and rotate his/her hands to a desired orientation for a biceps exercise (e.g., palm up or palm sideways for hammer curl) or triceps exercise and then change their orientation as and when needed during an exercise routine.

Figure 7:
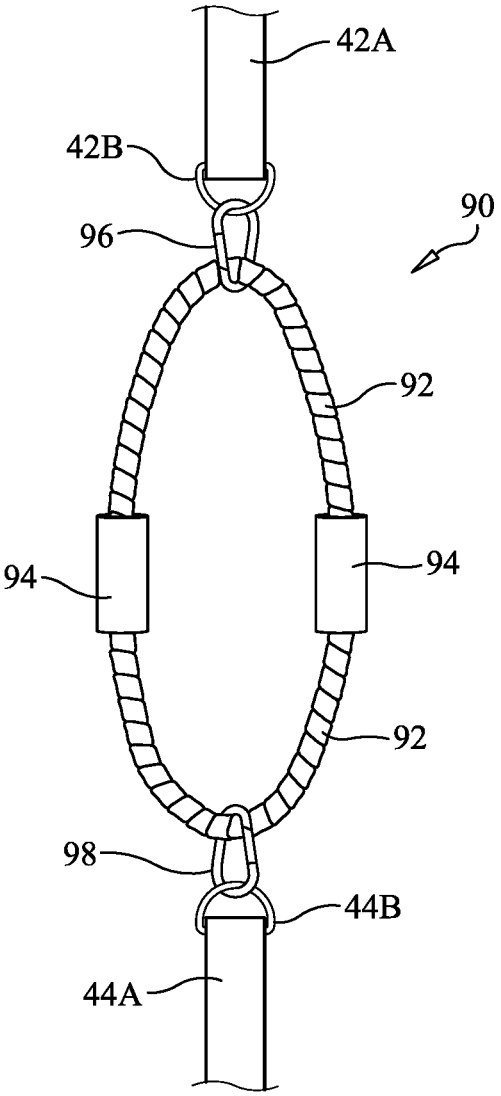
FIG. 7 is an isolated view of a flexible-loop grip for coupling to a biceps/triceps exercise machine in accordance with an embodiment of the present invention.

Referring now to FIG. 7, a flexible-loop grip device is shown and is referenced generally by numeral 90. Device 90 includes a flexible (rope) loop 92 with hand grips 94 coupled to loop 92 and located in diametric opposition to one another as shown. Each of hand grips 94 could be replaced by spaced-apart balls (not shown) in which case one could grip loop 92 directly between the balls. D-links 96 and 98 can be used to couple loop 92 to rings 42B and 44B, respectively.

Figure 8:
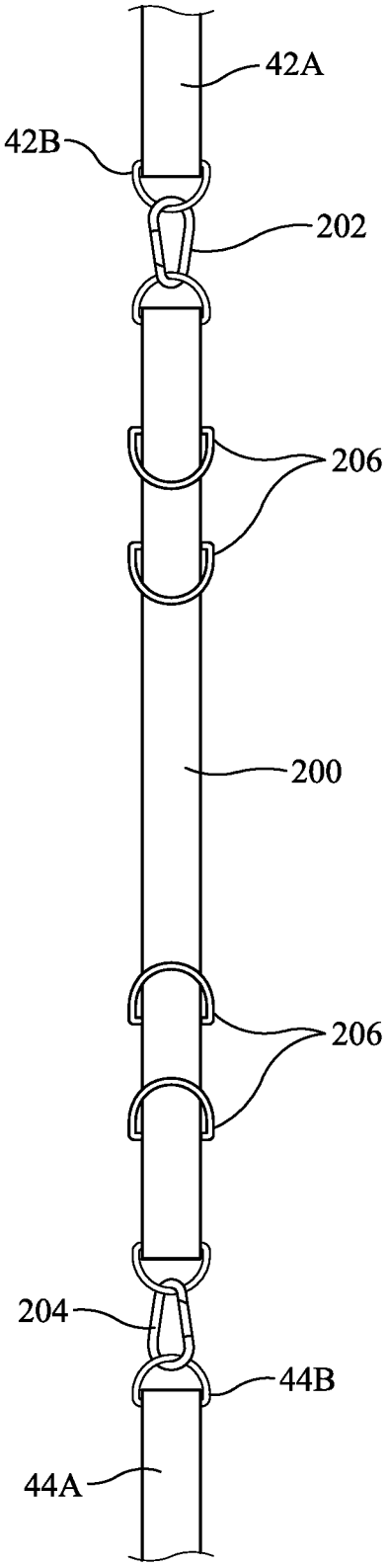
FIG. 8 is an isolated view of a multi-point support and flexible-loop grip for coupling to a biceps/triceps exercise machine in accordance with another embodiment of the present invention.

In order to allow a user to position his/her hands in a comfortable biceps exercise or triceps exercise position, it may be desirable to utilize one of the above-described bar-type grips or flexible-loop grip device 90 with a multi-point support that links the above-described lines 42A and 44A. Accordingly, FIG. 8 illustrates a rigid or semi-rigid linear support 200 coupled to rings 42B and 44B using D-links 202 and 204, respectively. Accordingly, support 200 provides the link between lines 42A and 44A. Disposed along the length of support 200 are a number of fixed-position rings 206 to which, for example, D-links 96 and 98 of grip device 90 can be attached to define a desired amount of slack in loop 92 depending upon which two of rings 206 are used to couple device 90 to support 200. Hand grips 94 would then be positioned at diametrically-opposed locations between the two of rings 206 used for attachment of device 90.

The advantages of the present invention are numerous. In one embodiment of the present invention, a user gets to set/adjust separate resistances for a biceps exercise and a triceps exercise, while performing both exercises on a single machine and in a fluent fashion. The exercise will simplify and guarantee effective agonist-antagonist muscle group training. The variety of grip devices will allow a user to exercise biceps and triceps muscle groups in multiple ways.

Although the invention has been described relative to a specific embodiments thereof, there are numerous variations and modifications that will be readily apparent to those skilled in the art in light of the above teachings. For example, the orientation of the machine can be changed along with the user-engaged link in order to adapt the exercise machine to other agonist-antagonist muscle groups. It is therefore to be understood that, within the scope of the appended claims, the invention may be practiced other than as specifically described.

What is claimed as new and desired to be secured by Letters Patent of the United States is:

1. An exercise machine for agonist-antagonist muscle training, comprising:

a first variable resistance mechanism having a first line extending therefrom, said first line adapted to have a first tensile force applied thereto wherein said first line extends from said first variable resistance mechanism when said first tensile force exceeds a first resistance force of said first variable resistance mechanism, and wherein said first line retracts towards said first variable resistance mechanism by a first restoring force of said first variable resistance mechanism when said first tensile force is terminated, wherein said first resistance force is greater than said first restoring force;

a second variable resistance mechanism having a second line extending therefrom, said second line adapted to have a second tensile force applied thereto wherein said second line extends from said second variable resistance mechanism when said second tensile force exceeds a second resistance force of said second variable resistance mechanism, and wherein said second line retracts towards said second variable resistance mechanism by a second restoring force of said second variable resistance mechanism when said second tensile force is terminated, wherein said second resistance force is greater than said second restoring force;

a link coupled to said first line and said second line wherein said first line, said second line, and said link are aligned along a common axis, said link adapted to be engaged by a user, wherein said link includes a linear support element having a plurality of attachment elements spaced-apart along a length of said linear support element;

a flexible loop coupled to two of said attachment elements of said linear support element, wherein said flexible loop is adapted to be gripped by a user at diametrically-opposed locations on said flexible loop between said two of said attachment elements;

said first variable resistance mechanism and said second variable resistance mechanism positioned relative to one another such that when the user applies said first tensile force in excess of said first resistance force to said first line via said link, said first line extends from said first variable resistance mechanism against said first resistance force while said second line retracts towards said second variable resistance mechanism under said second restoring force, and such that when the user applies said second tensile force in excess of said second resistance force to said second line via said link, said second line extends from said second variable resistance mechanism against said second resistance force while said first line retracts towards said first variable resistance mechanism under said first restoring force.

2. An exercise machine as in claim 1, further comprising:

a frame for supporting said first variable resistance mechanism and said second variable resistance mechanism in a fixed and spaced-apart vertical alignment; and a platform adjustably coupled to said frame wherein a position of said platform can be adjusted along a direction parallel to said common axis.

3. An exercise machine for agonist-antagonist muscle training, comprising:

a frame having an upper portion and a lower portion;

a first variable resistance mechanism coupled to said upper portion of said frame, said first variable resistance mechanism having a first line extending therefrom, said first line adapted to have a first tensile force applied thereto wherein said first line is pulled downward from said first variable resistance mechanism when said first tensile force exceeds a first resistance force of said first variable resistance mechanism, and wherein said first line retracts upwards towards said first variable resistance mechanism by a first restoring force of said first variable resistance mechanism when said first tensile force is terminated, wherein said first resistance force is greater than said first restoring force;

a second variable resistance mechanism coupled to said lower portion of said frame, said second variable resistance mechanism having a second line extending therefrom, said second line adapted to have a second tensile force applied thereto wherein said second line is pulled upward from said second variable resistance mechanism when said second tensile force exceeds a second resistance force of said second variable resistance mechanism, and wherein said second line retracts downward towards said second variable resistance mechanism by a second restoring force of said second variable resistance mechanism when said second tensile force is terminated, wherein said second resistance force is greater than said second restoring force;

a link coupled to said first line and said second line wherein said first line, said second line, and said link are aligned along a common vertical axis, said link adapted to be engaged by a user, wherein said link includes a linear support element having a plurality of attachment elements spaced-apart along a length of said linear support element;

a flexible loop coupled to two of said attachment elements of said linear support element, wherein said flexible loop is adapted to be gripped by a user at diametrically-opposed locations on said flexible loop between said two of said attachment elements;

said first variable resistance mechanism and said second variable resistance mechanism positioned relative to one another such that when the user applies said first tensile force in excess of said first resistance force to said first line via said link, said first line is pulled downward from said first variable resistance mechanism against said first resistance force while said second line retracts downward towards said second variable resistance mechanism under said second restoring force, and such that when the user applies said second tensile force in excess of said second resistance force to said second line via said link, said second line is pulled upward from said second variable resistance mechanism against said second resistance force while said first line retracts upward towards said first variable resistance mechanism under said first restoring force.

4. An exercise machine as in claim 3, further comprising an adjustable-height platform coupled to said lower portion of said frame wherein a vertical position of said platform is adjustable along a direction parallel to said common vertical axis.

* * * * *